US006749278B2

(12) United States Patent
Takayanagi

(10) Patent No.: US 6,749,278 B2
(45) Date of Patent: Jun. 15, 2004

(54) INK JET RECORDING APPARATUS AND CONTROL METHOD FOR RECORDING APPARATUS

(75) Inventor: Yoshiaki Takayanagi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/127,435

(22) Filed: Apr. 23, 2002

(65) Prior Publication Data

US 2002/0171694 A1 Nov. 21, 2002

(30) Foreign Application Priority Data

Apr. 26, 2001 (JP) ..... 2001-129743

(51) Int. Cl.[7] ..... B41J 29/38
(52) U.S. Cl. ..... 347/5
(58) Field of Search ..... 347/5, 1; 358/1.1, 358/1.2, 1.3, 1.4, 1.5, 1.6, 1.7, 1.8, 1.9, 2.1; 318/562

(56) References Cited

U.S. PATENT DOCUMENTS 5,617,122 A 4/1997 Numata et al.
5,638,097 A 6/1997 Takayanagi et al.
6,273,535 B1 8/2001 Inoue et al.

FOREIGN PATENT DOCUMENTS

| | | |
|---|---|---|
| EP | 1 078 752 | 2/2001 |
| JP | 10-226139 | 8/1998 |
| JP | 11-353061 | 12/1999 |
| WO | WO 98/08157 | 2/1998 |

*Primary Examiner*—Raquel Yvette Gordon
(74) *Attorney, Agent, or Firm*—Fitzpatrick, Cella, Harper & Scinto

(57) ABSTRACT

An ink jet recording apparatus, which is provided with the control circuit that controls the recording operation using a recording head, and the driving circuit that drives the recording head, comprises the power supply portion of a serial interface to supply power to the control circuit with a first voltage value, and a second voltage output circuit for supplying power to the driving circuit with a second voltage value. With the structure thus arranged, it becomes possible to utilize the power supply from the interface for driving the control circuit of the recording apparatus, while the power supply of the recording apparatus is dedicated as the power source for driving the recording head, hence materializing a smaller power supply circuit, and cost down as well.

14 Claims, 16 Drawing Sheets

AC INPUT
402
401
PRIMARY RECTIFICATION CIRCUIT
403
VOLTAGE CONVERTING CIRCUIT
405
SECONDARY RECTIFICATION CIRCUIT
407
SWITCHING CIRCUIT
409
FEEDBACK CIRCUIT
411
OUTPUT SHUTDOWN CIRCUIT
413
415
417
419
421
423
425
427
VD
0V
Vccl
POWER CIRCUIT
432
LOGIC CIRCUIT
434
430
438
440
450
GND
D−
D+
VBus
TO HOST APPARATUS

INK JET RECORDING APPARATUS AND CONTROL METHOD FOR RECORDING APPARATUS

BACKGROUND OF THE INVENTION

1. Field of the Invention

The present invention relates to an ink jet recording apparatus. More particularly, the invention relates to a circuit for supplying source power to a recording apparatus that effects recording with the provision of the power supply through a USB interface cable, as well as to a method for supplying source power.

2. Related Background Art

The power supply unit, which is mounted on the conventional printing apparatus, particularly on an ink jet printer, is generally provided with voltage (5 volts, for instance) for control circuit use, and voltage for driving circuit use to drive a motor or a recording head. Then, the voltage for the driving circuit use is further provided with two kinds of voltages, one for motor use and the other for recording head use. Thus, the three systems form the entire power supply structure. For some of the printing apparatuses, the motor voltage and the recording head voltage are commonly used to form the entire power supply structure by two systems.

As an interface used for these printing apparatuses, a parallel interface (that may also be called a centronics interface) that conforms to the IEEE1284 has been used in general.

In recent years, however, with the advancement in technologies to make the equipment smaller, and to provide a more effective operating system (OS) for a personal computer, a universal serial bus (USB) interface, which is capable of supporting the plug and play function, has been used more widely. For example, the Windows 98-OS produced by Microsoft Corporation, and the Mac-OS produced by Apple Computer Inc., among some other operating systems, support the USB interface as standard.

Whereas the conventional IEEE1284 interface comprises 8-bit data signal line, a plurality of control signal lines, and grounding line, the USB interface is a serial interface formed by D+, D− differential signal lines, 5-volt power supply line (power supply bus), and 4 grounding lines as shown in FIG. 1. In accordance with the USB specifications, the 5-volt USB power supply line (power supply bus) is regulated to supply electric power of maximum 5 volts at 500 milliamperes (hereinafter referred to as mA) from the host side, such as a personal computer, to a printing apparatus, such as a printer (which is defined as function by the USB terminology).

However, in order to provide the 500 mA, it is necessary to switch the power supply sources step by step in accordance with the designated communication protocol (which is performed at the time of bus enumeration). In other words, on the printer side, the low-power consumption status (the power value being 0.5 watts, the voltage value, 5 volts, and the current value, 100 mA or less) should be maintained, and then, by the bus enumeration control during this period, this is controlled and changed to the power status (the power value being 2.5 watts, the voltage value, 5 volts, and the current value, 500 mA or less) for recording operation due to the total power in demand.

Here, for the conventional printer, both the voltage for control circuit use and the voltage for driving circuit use are supplied from the DC power unit, which is generally provided inside the printer for its own use.

As a result, the conventional printing apparatus does not utilize the power from the USB power supply portion (USB power supply line) fully despite receiving the power supply from the USB power portion (USB power supply line). On the other hand, there is a problem at present that the power consumption of the printing apparatus should be made lower still, and the utilization of the power from the USB power supply portion (USB power supply line) should be taken into consideration as a subject to cope with the situation.

SUMMARY OF THE INVENTION

The present invention is designed to solve this problem. It is an object of the invention to provide an ink jet recording apparatus, which is provided with the control circuit that controls the recording operation using a recording head, and the driving circuit that drives the recording head, comprising the power supply portion of a serial interface to supply power to the control circuit with a first voltage value, and a second voltage output circuit for supplying power to the driving circuit with a second voltage value.

Another recording apparatus of the present invention, which is provided with a control circuit for controlling the recording operation using a recording head, and a driving circuit for driving the driving source to drive the recording head, comprises the power supply portion of a serial interface to supply power to the control circuit with a first voltage value, a power supply unit having a first voltage output circuit for supplying power to the control circuit with a first voltage value, and a second voltage output circuit for supplying power to the driving circuit with a second voltage value. For this recording apparatus, the power supply to the control circuit from the first output circuit and the power supply portion of the serial interface is executed in accordance with the status of the power supply portion of the serial interface.

The method of the present invention for controlling an ink jet recording apparatus, which is provided with a control circuit for controlling the recording operation using a recording head, and a driving circuit to drive the recording head, comprises the steps of operating the control circuit in the recording operation with the power supply from the power supply portion of a serial interface with a first voltage value, and operating the driving circuit by the power supply from the power supply unit with a second voltage value.

DETAILED DESCRIPTION OF THE PREFERRED EMBODIMENTS

Figure 11:
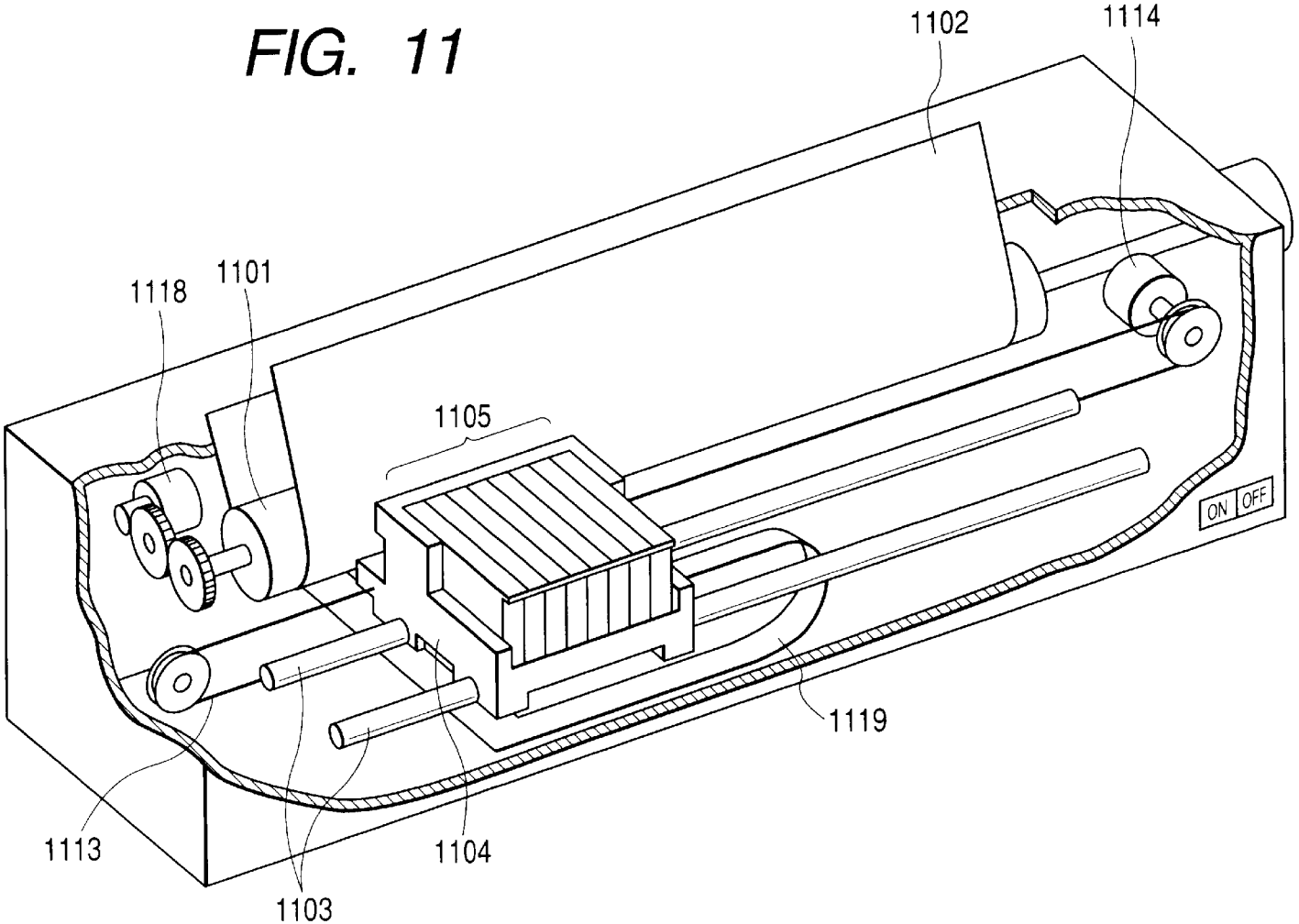
FIG. 11 is a perspective view that shows a printing apparatus.

FIG. 11 is a perspective view that shows the ink jet recording apparatus (printing apparatus) in accordance with the present invention.

A reference numeral 1105 designates a recording head, which is mounted on a carriage 1104 to be able to reciprocate in the longitudinal direction along a shaft 1103. Ink discharged from the recording head arrives at a recording material 1102, the recording surface of which is regulated by a platen 1101, and forms images thereon.

To the recording head, discharge signals are supplied in accordance with image data through a flexible cable 1119. In this respect, a reference numeral 1114 designates a carriage motor that enables the carriage 1104 to perform its main scan along the shaft 1103; 1113, the wire that transmits the driving power of the motor 1114 to the carriage 1104; and 1118, a carrier motor coupled with the a platen roller 1101 to convey the recording material 1102. This ink jet recording apparatus is connected with a host computer through the USB interface to receive image data transmitted from the computer.

Figure 1:
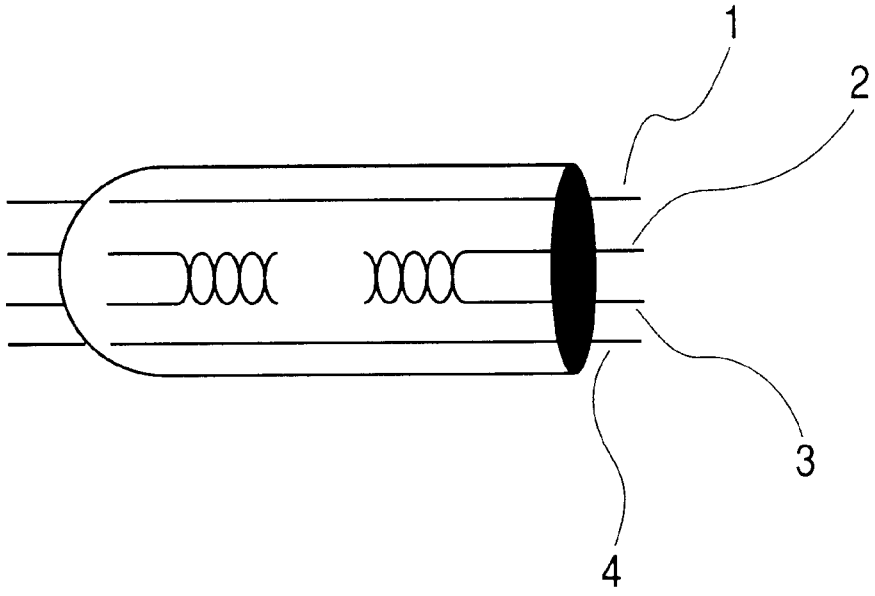
FIG. 1 is a view that shows the structure of the USB cable.

FIG. 1 shows the USB interface signal lines. A reference numeral 1 designates the power source line V Bus of 5 volts; 2, D+; 3, D−; and 4, GND (ground): four signals lines in total constitute the interface.

In this respect, the resolution of the recording head is 600 dpi. The recording head is of the ink jet type having 128 recording elements arranged therefor. The recording element is formed by a driving unit and nozzles. The driving unit makes it possible to give heat to ink by use of heaters. With heat thus provided, film boiling is generated in ink, and ink is discharged from each of the nozzles by pressure changes caused by the growth or shrinkage of bubbles generated by such film boiling.

(First Embodiment)

Figure 2:
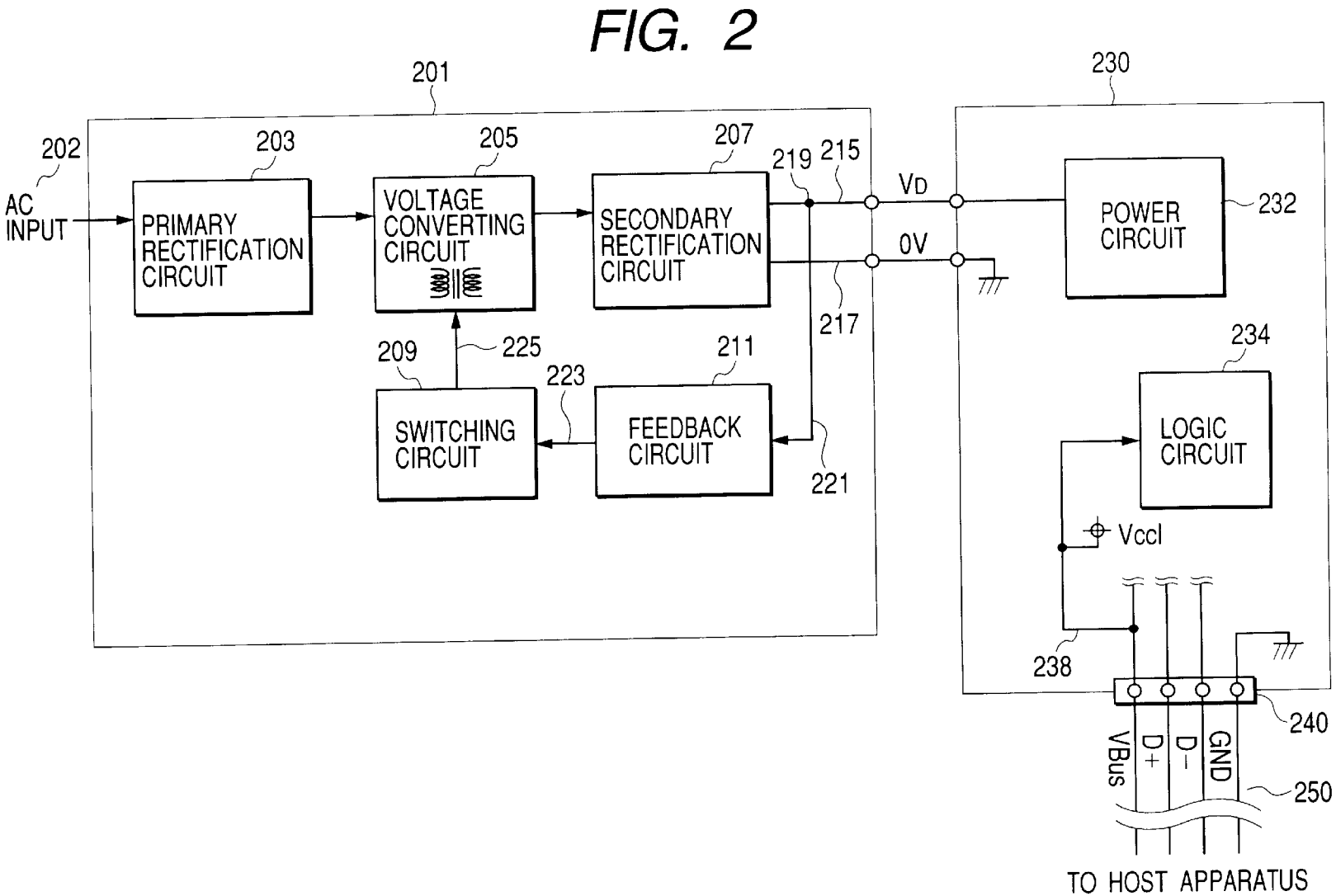
FIG. 2 is a view that shows a power supply system in accordance with a first embodiment.

FIG. 2 is a view that shows the circuit structure of a printing apparatus in accordance with a first embodiment of the present invention. The printing apparatus comprises a controller unit 230 and a power supply unit 201. In the controller unit 230, there are provided the control circuit containing a CPU, a storage, an ASIC and the like, which operates by DC voltage of 5 volts, and the driving circuit that drives the driving sources, such as a carriage motor, a carrier motor, and a recording head, by the application of DC voltage of 24 volts.

Hereinafter, the control circuit will be described as a logic circuit 234, and the driving circuit, as a power circuit 232.

A connector 240 is the USB interface connector. The connector is provided with four terminals, the power supply line V Bus, GND, D+ and D−, respectively.

The power supply unit 201 contains a primary rectification circuit 203, a voltage converting circuit 205, a secondary rectification circuit 207, a switching circuit 209, and a feedback circuit 211. The switching circuit 209 and the feedback circuit 211 constitute a stable (stabilizing) circuit that stabilizes voltage VD. The feedback circuit 211 outputs signals to enable the output voltage of the secondary rectification circuit 207 to be lowered if it is high or to be raised if the output voltage is low. The switching circuit 209 controls the primary side of the voltage converting circuit 205 appropriately when receiving signals from the feedback circuit 211. In this manner, the high or low level of the voltage is adjusted on the secondary side of the voltage converting circuit 205.

The USB power supply portion (USB power supply line) 238 presents zero volt if the USB cable 250 is not connected or the host computer is in the power-off status even with the USB cable 250 being connected. In this state, the Vcc1 in the controller becomes zero volt, and the logic circuit 234 is suspended.

Next, when the USB cable 250 is connected, and the host computer is turned on, the Vcc1 in the controller becomes 5 volts to enable the operation of the logic circuit 234 to begin.

With the Vcc1 being 5 volts, the CPU initiates the printing apparatus to provide the standby mode. At this juncture, the dissipation current of the voltage Vcc1 in the controller 230 is 100 mA or less in general.

Next, when a printing command is given (issued) from the host computer, the printing apparatus shifts the standby mode to the operation mode to begin printing. During this period, the dissipation current of the voltage Vcc1 is generally greater than that of the standby mode. Typically, it is within a range of 100 mA to 500 mA. As described earlier, the USB power supply line can supply up to 500 mA maximum. Therefore, within this range, it can function effectively.

After the completion of the printing operation, if the USB cable is cut off during the standby mode or the host computer is turned off, the Vcc1 becomes zero volt to suspend the operation of the logic circuit 234.

Here, the operation mode is such as the printing operation in which the recording head performs printing on a recording material or the status in which a recovery operation is effectuated in order to maintain the recording head in good condition.

When a switch (not shown) is turned on, the voltage VD becomes 24 volts to supply it to the power circuit 232. If the switch is turned off, the voltage VD becomes zero to cut off the power supply to the power circuit 232.

For the first embodiment, power for use of the logic circuit is supplied from the USB power supply portion (USB power supply line). As a result, it becomes unnecessary to provide any voltage generation circuit dedicated to the use of the logic circuit in the power supply unit, hence making it possible to make the power supply unit smaller and materialize the cost down. Also, receiving power from the host computer makes it possible to materialize the smaller power consumption of the printing apparatus.

(Second Embodiment)

Figure 4:
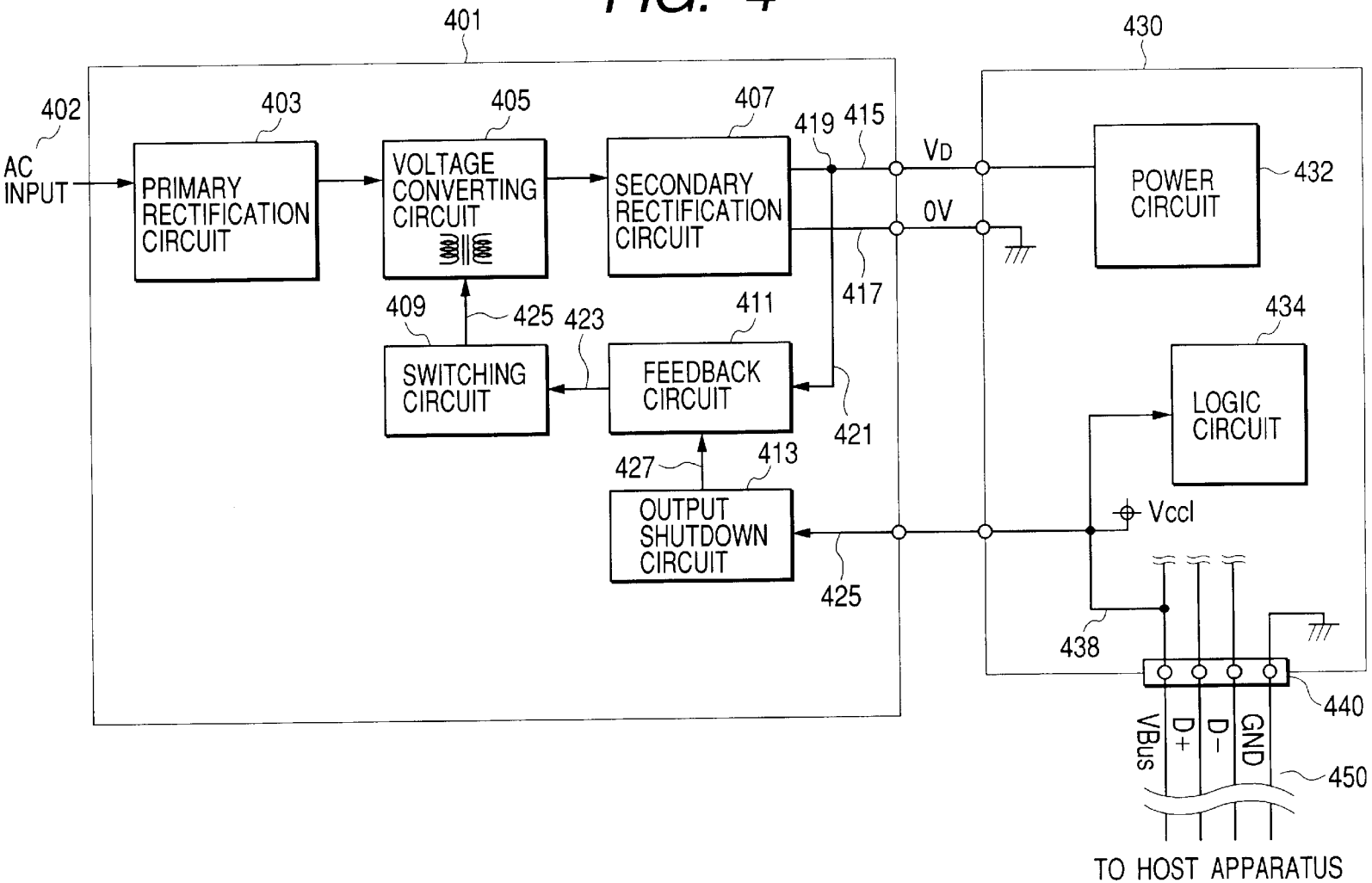
FIG. 4 is a view that shows a power supply system in accordance with the second embodiment.

FIG. 4 is a view that shows the circuit structure of a printing apparatus in accordance with a second embodiment of the present invention. The printing apparatus comprises a controller unit 430 and a power supply unit 401. In the controller unit 430, there are provided the control circuit containing a CPU, a storage, an ASIC, and the like, which operates by DC voltage of 5 volts, and the driving circuit that drives the driving sources, such as a carriage motor, a carrier motor, and a recording head, by the application of DC voltage of 24 volts. The power supply unit 401 makes the voltage VD 24 volts or zero volt depending on the presence or absence of the AC input.

Hereinafter, the control circuit will be described as a logic circuit 434, and the driving circuit, as a power circuit 432.

A connector 440 is the USB interface connector. The connector is provided with four terminals, the power supply line V Bus, GND, D+ and D−, respectively. The V bus terminal, to which the power supply line is connected, is connected with an output shut down circuit 413 through the signal line 425.

The power supply unit 401 contains a primary rectification circuit 403, a voltage converting circuit 405, a secondary rectification circuit 407, a switching circuit 409, and a feedback circuit 411. The switching circuit 409 and the feedback circuit 411 constitute a stable circuit that stabilizes voltage VD. Here, the stabilizing control is the same as that of the first embodiment. Therefore, the description will be omitted.

Figure 3:
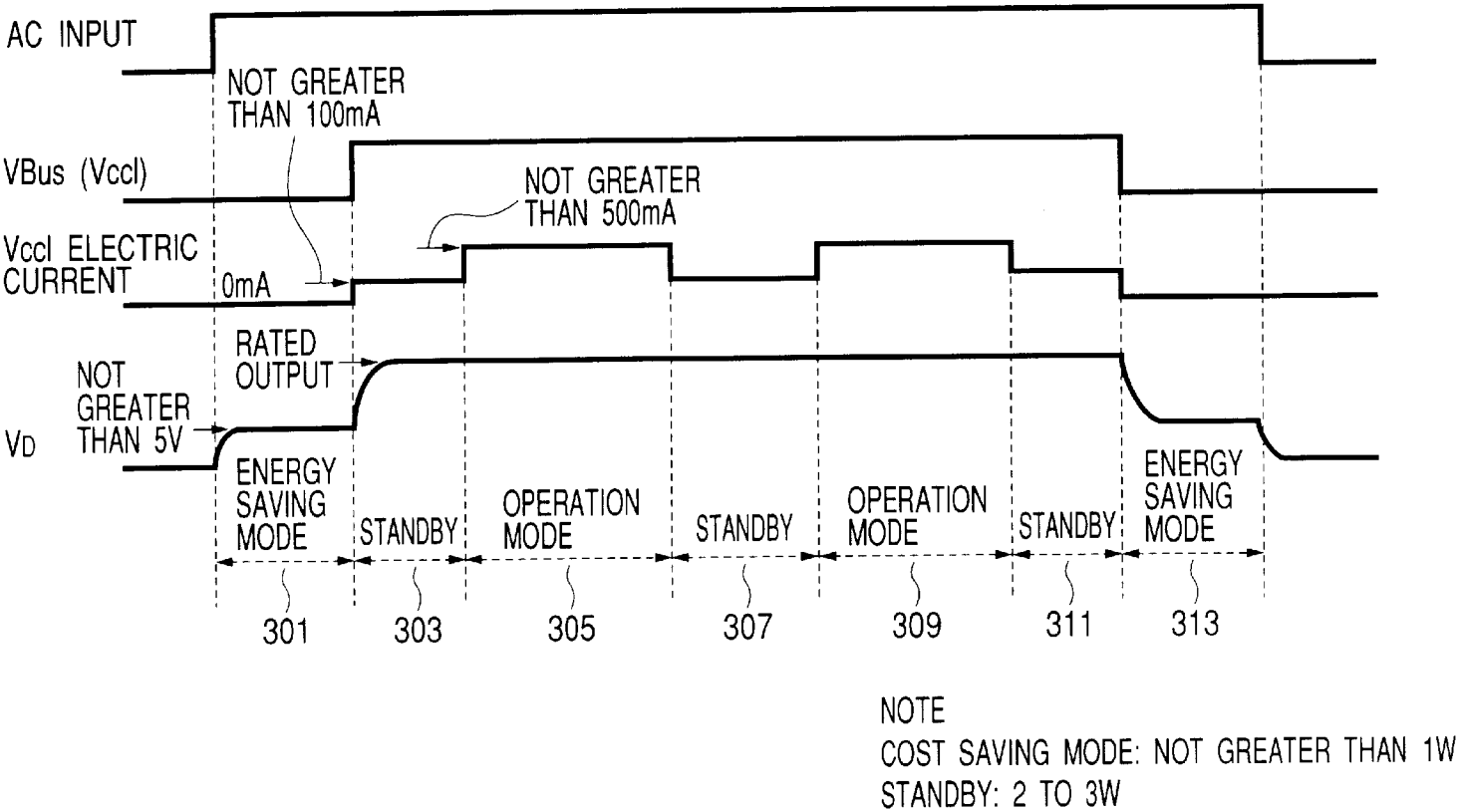
FIG. 3 is a view that shows an operational sequence in accordance with a second embodiment.

FIG. 3 is a view that shows an operation sequence. Next, in conjunction with FIG. 3, the description will be made of the control of the power supply voltage. In FIG. 4, it is assumed that the USB cable 450 is not connected or it is connected with the host computer in the power-off status.

In this case, the potential Vcc1 of the USB power supply portion (USB power supply line) 438 presents zero voltage, and the voltage Vcc1, which is zero volt, is transmitted to the output shut down circuit 413 in the power supply unit 401 through the signal line 425. The output shut down circuit 413 outputs to the feedback circuit 411 the signal that enables the voltage VD to be lowered to 5 volts or less. This signal is transmitted through the signal line 427. Further, the signal to lower the voltage is transmitted from the feedback circuit 411 to the switching circuit 409 through the signal line 423.

From the switching circuit 409 the signal that lowers the voltage output to 5 volts or less is transmitted to the power supply converting circuit 405 through the signal line 425. As a result, the voltage VD becomes 2.0 volts to 3.0 volts by way of the secondary rectification circuit 407. This is materialized by means of the intermittent oscillation of the voltage converting circuit 405 that contains a transformer.

Here, the reason that the voltage VD is kept at 5 volts or less is that the logic circuit 434 should be protected from the voltage VD, which is a high voltage, when the voltage Vcc1 is not supplied to the controller portion 430. This state is represented at 301 in FIG. 3, and during this period, the power saving mode is effectuated (the dissipation power of which is 1 watt or less, for instance) because as described above the status is such as to effectuate the intermittent oscillation, for example.

Next, when the USB cable 450 is connected, and the host computer is turned on, the status changes as represented at 303 in FIG. 3. In this state the Vcc1 in the controller becomes 5 volts to enable the operation of the logic circuit 434 to begin.

With the Vcc1 being 5 volts, the CPU initiates the printing apparatus to provide the standby mode. At this juncture, the dissipation current of the voltage Vcc1 in the controller 430 is 100 mA or less in general. For the second embodiment, the power supply unit 401 controls the voltage VD to a designated DC voltage at this juncture. Generally, the dissipation power of the printing apparatus is approximately 2 watts to 3 watts in the standby mode.

Next, when a printing command is given (issued) from the host computer, the printing apparatus shifts the standby mode to the operation mode 305 to begin printing. During this period, the dissipation current of the voltage Vcc1 is generally greater than that of the standby mode. Typically, it is within a range of 100 mA to 500 mA. As described earlier, the USB power supply portion (USB power supply line) can supply up to 500 mA maximum. Therefore, within this range, it can function effectively.

After the completion of the printing operation, the printing apparatus shifts to the standby mode again, and the dissipation current of the voltage Vcc1 is also lowered to 100 mA or less again. Such cycle is repeated, and if the USB cable is cut off during the standby mode or the host computer is turned off, the Vcc1 becomes zero volt. Then, as described earlier, this is notified through the signal line 425 as shown in FIG. 4, and the voltage VD is lowered to DC 5 volts or less again. As a result, the printing apparatus enters the power saving mode again where the dissipation power is reduced to 1 watt or less, for example.

In this respect, even when the potential of the V Bus does not satisfy the 5 volts, which is the regulation voltage, the output shut down circuit 413 may be allowed to execute the process to lower the voltage VD irrespective of the case where it is zero volt.

In accordance with the second embodiment, it is possible to protect the logic circuit from the high voltage of the driving circuit in the status that the USB cable is not connected or the connection thereof is improper or connected but the host computer is turned off.

(Third Embodiment)

Figure 5:
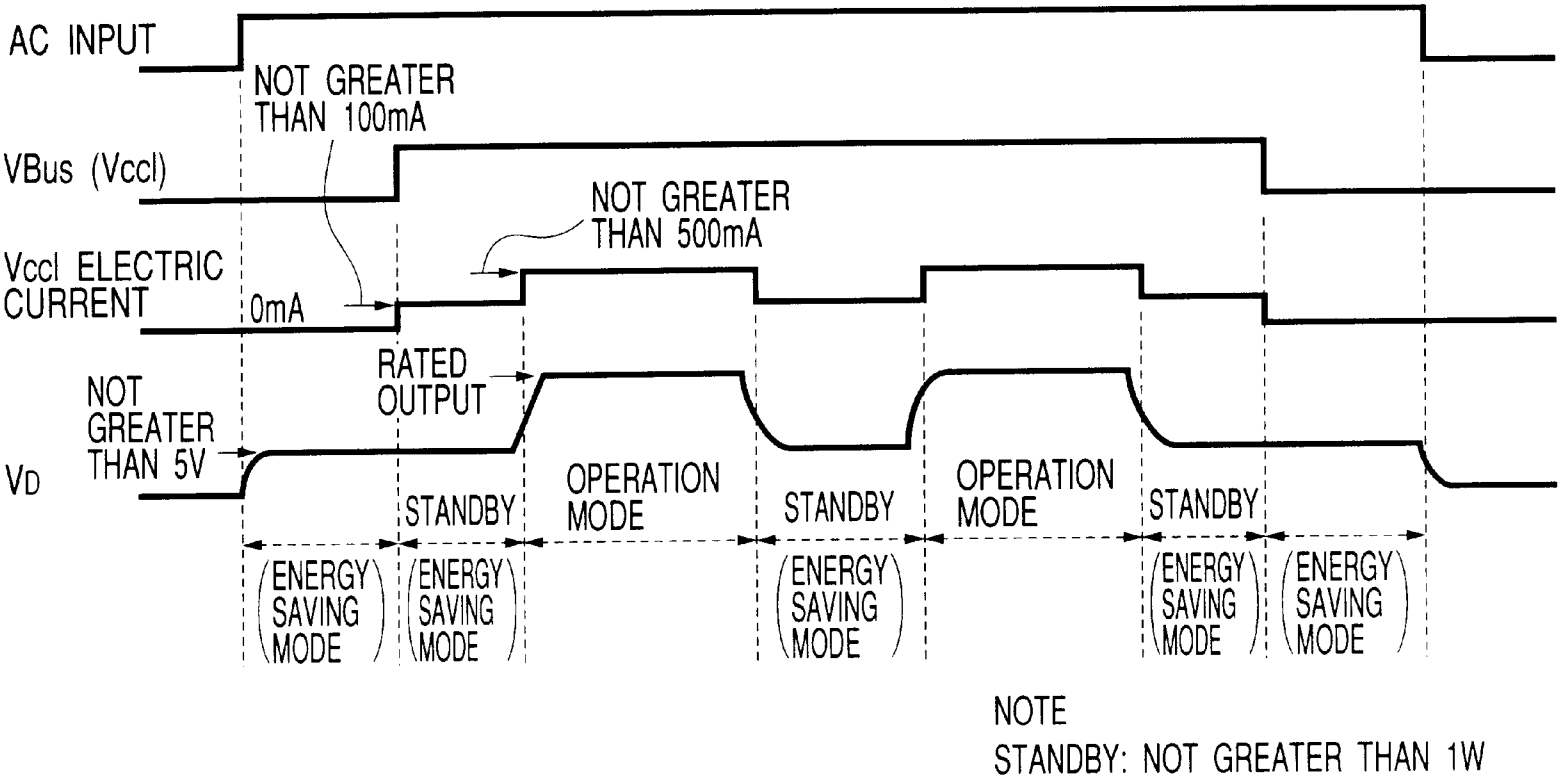
FIG. 5 is a view that shows an operational sequence in accordance with a third embodiment.
Figure 6:
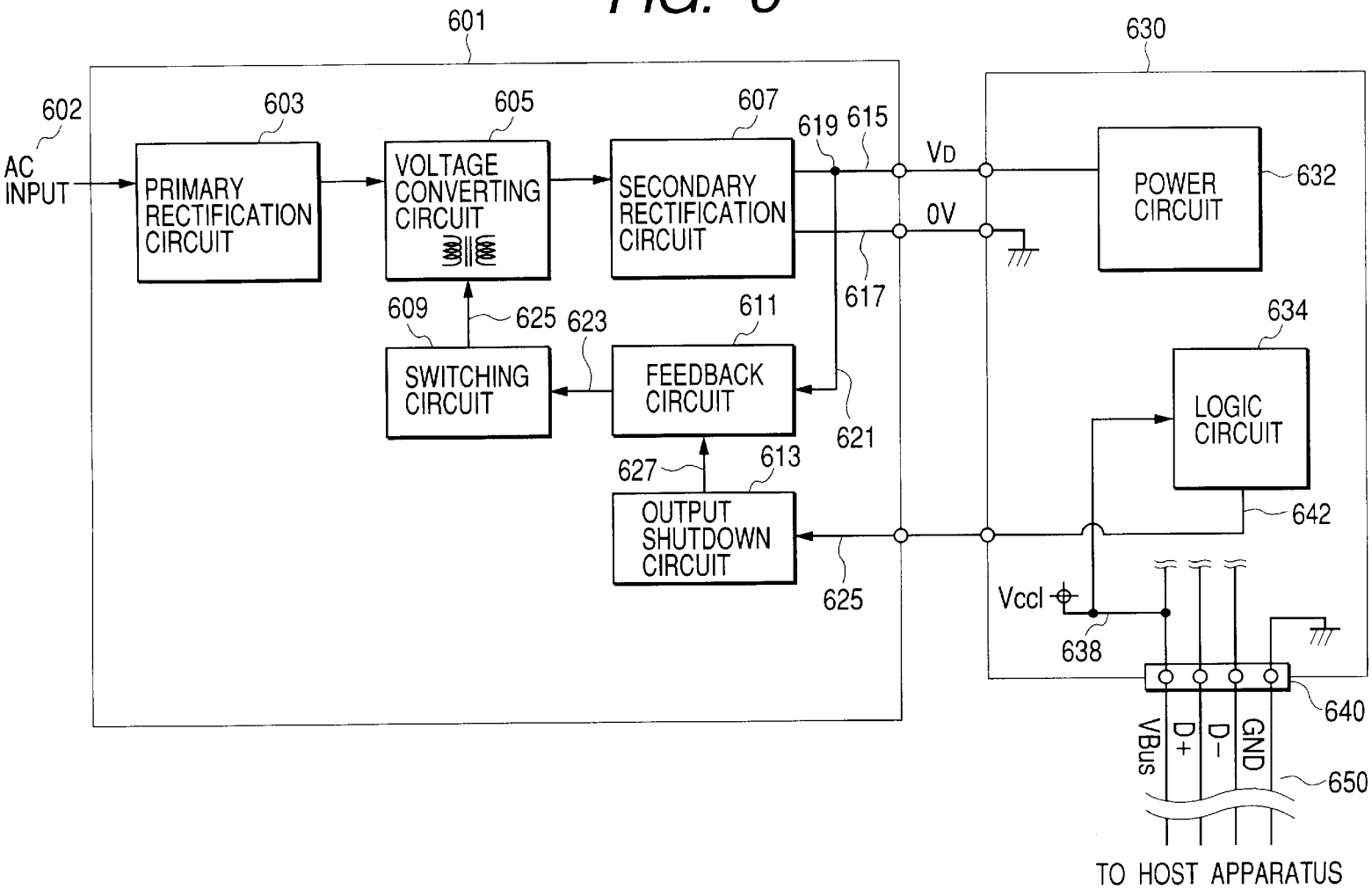
FIG. 6 is a view that shows a power supply system in accordance with the third embodiment.

FIG. 6 shows a third embodiment. FIG. 6 is the variation of the circuit structure shown in FIG. 2. The operation sequence thereof is shown in FIG. 5. The printing apparatus shown in FIG. 6 comprises a controller unit 630 and a power supply unit 601. For the power supply unit 601, the voltage VC is 24 volts or zero volt depending on the presence or absence of the AC input.

As in the first embodiment, there are provided in the controller unit 630 the control circuit containing a CPU, a storage, an ASIC, and the like, which operates by DC voltage of 5 volts, and the driving circuit that drives the driving sources, such as a carriage motor, a carrier motor, and a recording head, by the application of DC voltage of 24 volts.

Hereinafter, the control circuit will be described as a logic circuit 634, and the driving circuit, as a power circuit 632.

The power supply unit 601 contains a primary rectification circuit 603, a voltage converting circuit 605, a secondary rectification circuit 607, a switching circuit 609, and a feedback circuit 611. The switching circuit 609 and the feedback circuit 611 constitute a stable circuit that stabilizes voltage VD. Here, the stabilizing control is the same as those of the first embodiment and the second embodiment. Therefore, the description will be omitted.

In FIG. 6, unlike the voltage of the Vcc1 in the case represented in FIG. 2, the control signal 642, which is output from the logic circuit 634, is transmitted as the input signal 625 to the output shut down circuit in the power supply unit.

In FIG. 5, the voltage VD is lowered to a value of 5 volts or less in the standby mode. In this standby mode, the recording head, motors, and other recording devices are not in operation.

The CPU in the logic circuit 634 determines whether the standby mode or the operation mode that needs 24 volts is currently required, and then, issues instruction to the output shut down circuit 613 to lower the voltage VD.

More specifically, the voltage of zero volt is transmitted to the output shut down circuit 613 in the power supply unit 601 through the signal line 642. Then, from the output shut down circuit 613, the signal that indicates the zero volt status is transmitted to the feedback circuit 611 through the signal line 627. Further, from the feedback circuit 611, the signal that indicates the zero volt status is transmitted to the switching circuit 609 through the signal line 623.

The switching circuit 609 transmits the signal that lowers the output voltage to 2.0 to 3.0 volts, which is lower than 5 volts, to the power supply converting circuit 605 through the signal line 625. As a result, the voltage VD becomes 2.0 to 3.0 volts by way of the secondary rectification circuit 607. This is materialized by means of the voltage converting circuit 605 that contains a transformer.

In this respect, the condition needed to lower the output voltage of the voltage VD may be applicable to the case where the output of power to the power circuit should be suspended, such as in the initialization status, erroneous condition or abnormal condition, besides the case where the printing apparatus is brought to the standby mode. Also, the target value of lowered voltage is not necessarily 2.0 to 3.0 volts. It may be zero to 1.0 volt, for example.

Here, the initialization status means the period during which the CPU or ASIC is initialized in the control circuit, and memory check or error check of sensors of the apparatus is executed by the control circuit. During this period, no operation is performed as to the ink discharge operation of the head, the motor driving, or the like.

The erroneous condition means such case as jamming having taken place in the operation of conveying paper sheet or film, for example. The abnormal condition means the case where the temperature of the recording head rises abnormally, for example.

In the initialization status, erroneous condition, or abnormal condition, the discharge operation of the recording head and the driving of motors are suspended.

As described above, this embodiment makes it possible to discriminate the driving conditions of the logic circuit by means of the CPU in the logic circuit 634 in addition to the effect demonstrated by the first embodiment as described earlier. In accordance with the discrimination thus made, the power control is effectuated to lower the dissipation power of the driving circuit as in the case of the standby mode.

(Fourth Embodiment)

Figure 7:
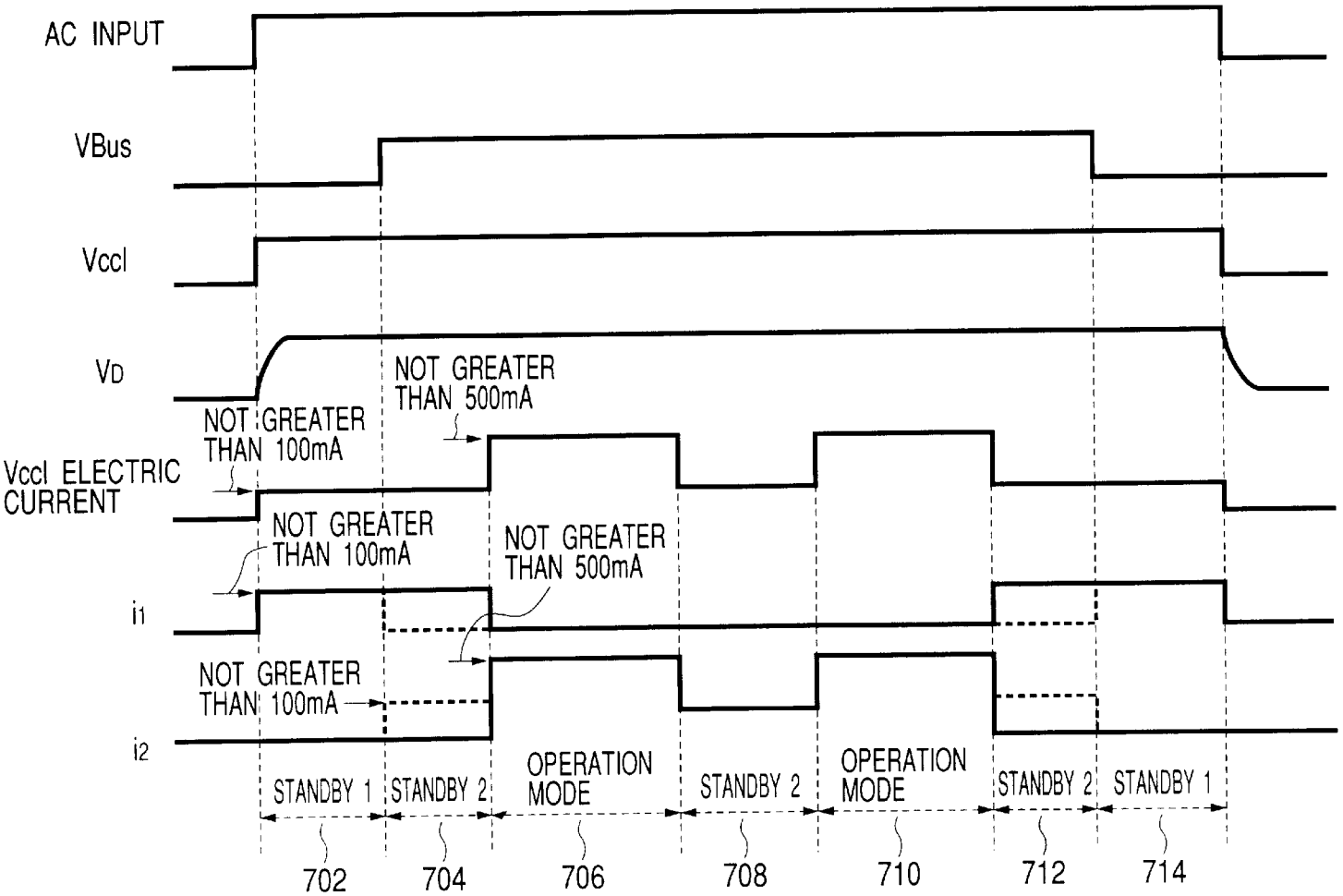
FIG. 7 is a view that shows an operational sequence in accordance with a fourth embodiment.
Figure 8:
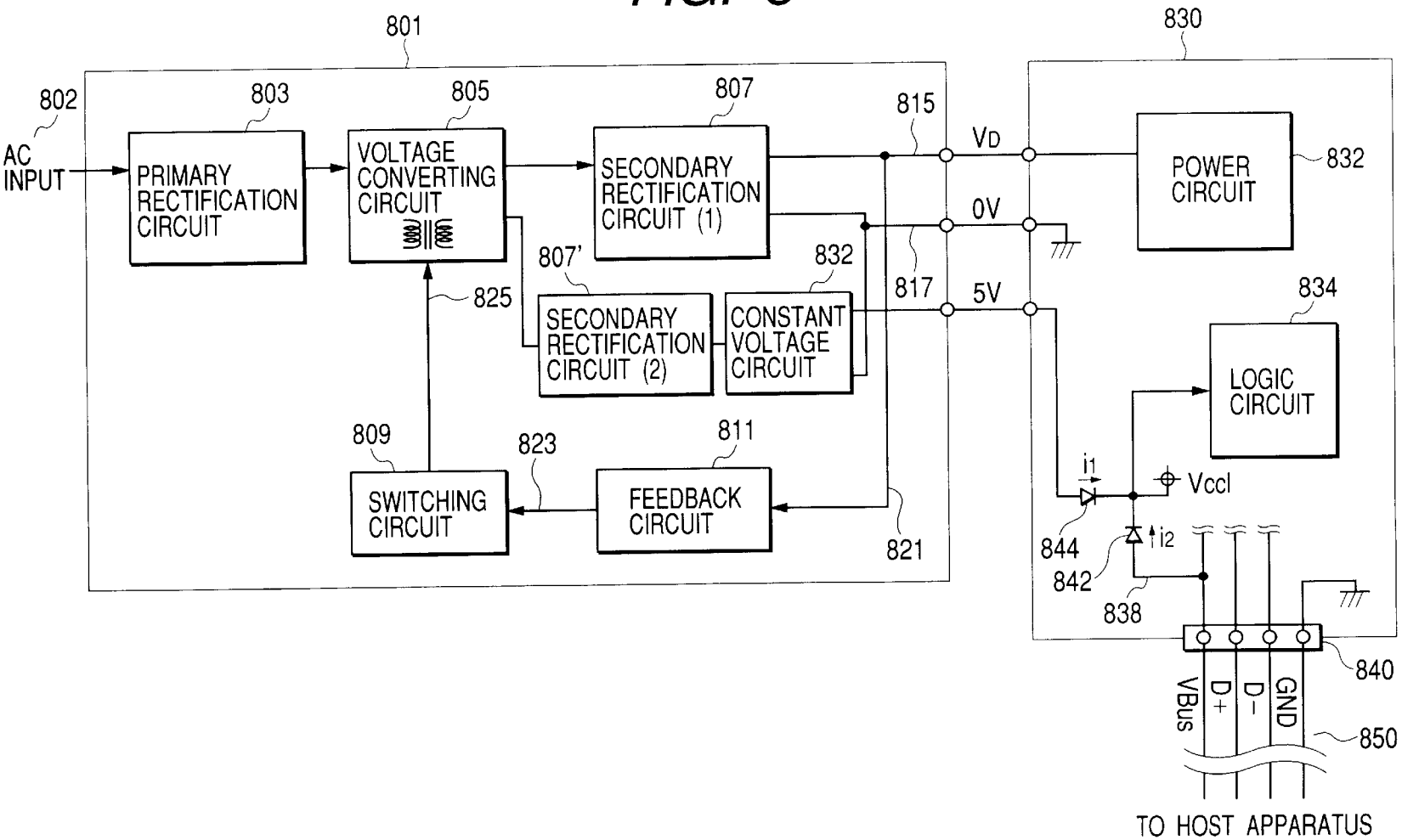
FIG. 8 is a view that shows a power supply system in accordance with the fourth embodiment.

FIG. 8 further shows the circuit structure of a fourth embodiment of the present invention. The operation sequence thereof is shown in FIG. 7.

As in the first and second embodiments, there are provided in the controller unit 830 the control circuit containing a CPU, a storage, an ASIC, and the like, which operates by DC voltage of 5 volts, and the driving circuit that drives the driving sources, such as a carriage motor, a carrier motor, and a recording head, by the application of DC voltage of 24 volts.

Hereinafter, the control circuit will be described as a logic circuit 834, and the driving circuit, as a power circuit 832.

The power supply unit 801 contains a primary rectification circuit 803, a voltage converting circuit 805, a secondary rectification circuit 807, a switching circuit 809, and a feedback circuit 811. The switching circuit 809 and the feedback circuit 811 constitute a stable circuit that stabilizes voltage VD. Here, the stabilizing control is the same as those of the first embodiment to the third embodiment. Therefore, the description will be omitted.

In FIG. 8, the power supply unit 801 generates two systems of voltage, that is, the voltage VD, which is the DC voltage, and 5 volts. Here, the 5 volts is generated by means of the secondary rectification circuit (2) 807', and the constant voltage circuit 832. When a switch (not shown) is turned on, the voltage VD is supplied to the power circuit 832, and the 5-volt voltage is supplied to the logic circuit 834. Also, when the switch is turned off, the power supplies to the power circuit 832 and the logic circuit 834 are cut off.

However, the power supply of 5 volts is just capable of supplying the current that is consumed by the printing apparatus during the standby mode 1, that is, approximately 100 mA.

Now, in conjunction with FIG. 7, the description will be made. During the period from the supply of the AC input to the connection of the USB cable with the host computer or during the period from the supply of the AC input in a state where the USB cable is connected with the host computer to the turn-on of the host computer (the period at 702 in FIG. 7), the voltage Vcc1 of the controller 830 of the printing apparatus is being supplied from the power supply unit 801 through the diode 844. At this juncture, the current i1 that flows in the diode 844 is DC 100 mA or less.

In this way, it becomes possible to execute operation up to the standby mode 1 even if there is no power supply from the USB cable. Thus, the printing apparatus can rise in a shorter period of time.

Next, when the USB cable is connected with the host computer, which is turned on, or when the host computer is turned on in a state where the USB cable and the host computer are connected, the potential of the USB power supply portion (USB power supply line) becomes 5 volts, and the 5-volt power is supplied. The printing apparatus shifts to the standby mode 2 (period at 704). In this state, the voltage Vcc1 of the controller 830 of the printing apparatus is supplied from the USB power supply portion (USB power supply line) 838 though the diode 842.

In other words, the current i1 running to the diode 844 and the current i2 running to the diode 842 are joined together to supply the current of total 100 mA to the logic circuit 834. (When the logic circuit 834 consumes 100 mA, the total current value of the current i1 and current i2 is 100 mA, and each of the current values is determined by the parameter of the circuit within a range of 0 mA to 100 mA.)

On the contrary, when the USB cable is removed from the host computer, which is turned on, or the host computer is turned off in a state where the USB cable and the host computer are connected, the power supply portion of the USB interface becomes zero volt. As a result, there is no current running from the USB power supply portion (USB power supply line) 838, but only the current of 100 mA from the power supply unit 801. In other words, the power supply source to the logic circuit 834 becomes only the power supply unit 801.

Here, the functions of the diodes 844 and 842 in FIG. 8 are to prevent the power supply from being destroyed due to any collision between 5-volt voltage supplied from the power supply unit 801 and the 5-volt voltage supplied from the USB power supply portion (USB power supply line) 838 or the controller 830.

With these diodes, it becomes possible to prevent the current running from the power supply unit 801 from running to the USB power supply portion (USB power supply line) or, on the contrary, to prevent current supplied from the USB power supply portion (USB power supply line) from running to the power supply unit 801. In this manner, it is possible to protect the circuit of the power supply unit and both the USB power supply portion (USB power supply line) and USB interface from the reverse-directed current.

In FIG. 7, when the standby mode shifts to the operation mode 706, the current that should be consumed as the voltage Vcc1 rises to 500 mA maximum. Therefore, in this state, it becomes no longer possible to supply all the required current only from the power supply unit 801. Essentially, the majority of the voltage Vcc1-current is supplied through the USB power supply portion (USB power supply line) 838.

When the operation mode is over, the printing apparatus returns to the standby mode 2 (708) again, and thereafter, the above cycle is repeated. Lastly, when the user removes the USB cable or the host computer is turned off, the USB power supply portion (USB power supply line) 838 becomes zero volt.

The printing apparatus again returns to the standby mode 1 (the period at 714 in FIG. 7), and the controller 830 receives the supply of the current of voltage Vcc1 from the power supply unit 801.

Here, the operation mode means the printing operation in which the recording head executes printing on a recording material, and the recovery operation whereby to maintain the recording head in good condition.

As described above, in accordance with the operation mode, the power supply is effectuated for the control circuit, and with the supply capability of the 5-volt power supply circuit portion being confined to 100 mA, the secondary rectification circuit (2) 807' and the circuitry of the constant voltage circuit 832 are simplified to make the cost down possible.

Also, the power supply unit is structured to supply power with the control circuit being in the standby mode or standby mode 2. As a result, the power consumption is made lower. Further, when the USB cable is not connected with the host computer or even when the host computer is turned off, the printing apparatus can operate the initialization other than those for mechanical operations.

(Fifth Embodiment)

Figure 10:
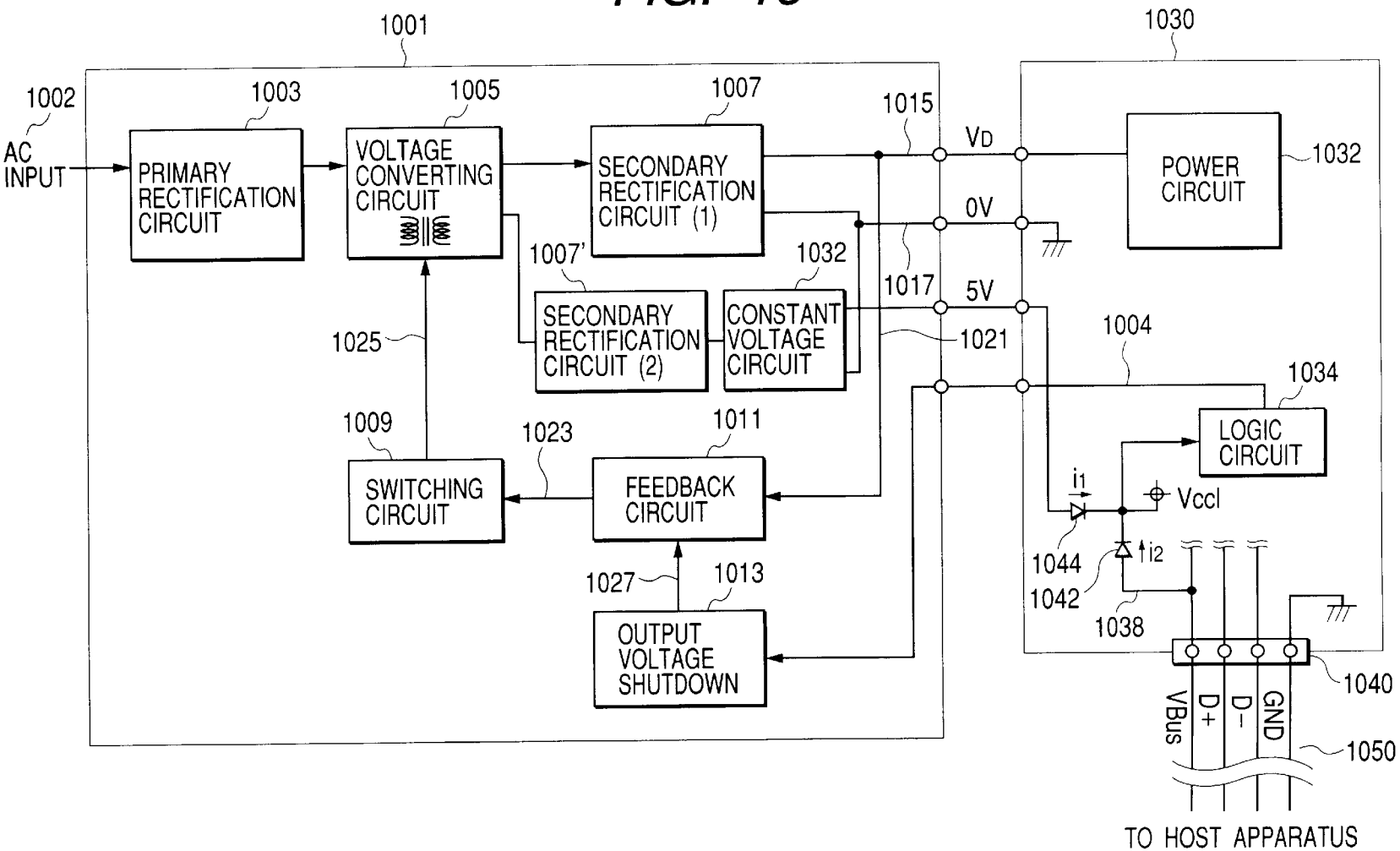
FIG. 10 is a view that shows a power supply system in accordance with the fifth embodiment.

FIG. 10 shows a fourth embodiment of the present invention. As in the first to fourth embodiments, there are provided in the controller unit 1030 the control circuit containing a CPU, a storage, an ASIC, and the like, which operates by DC voltage of 5 volts, and the driving circuit that drives the driving sources, such as a carriage motor, a carrier motor, and a recording head, by the application of DC voltage of 24 volts.

Hereinafter, the control circuit will be described as a logic circuit 1034, and the driving circuit, as a power circuit 1032.

The power supply unit 1001 contains a primary rectification circuit 1003, a voltage converting circuit 1005, a secondary rectification circuit 1007, a switching circuit 1009, and a feedback circuit 1011. The switching circuit 1009 and the feedback circuit 1011 constitute a stable circuit that stabilizes voltage VD. Here, the stabilizing control is the same as those of the first embodiment to the fourth embodiment. Therefore, the description will be omitted.

In FIG. 10, the power supply unit 1001 generates two systems of voltage, that is, the voltage VD, which is the DC voltage, and 5 volts. Here, the 5 volts are generated by means of the secondary rectification circuit (2) 1007', and the constant voltage circuit 1032. When a switch (not shown) is turned on, the voltage VD is supplied to the power circuit 1032, and the 5-volt voltage is supplied to the logic circuit 1034. Also, when the switch is turned off, the power supplies to the power circuit 1032 and the logic circuit 1034 are cut off.

In FIG. 10, an output shut down circuit 1002 is additionally provided in the power supply unit 1001. This circuit enables the CPU in the logic circuit 1034 to discriminate the standby mode and the operation mode and instruct the shut down circuit 1013 to lower the voltage VD during the period when the voltage VD is not needed (during the standby mode, for example).

The Vcc1 voltage of zero volt is transmitted to the output shut down circuit 1013 in the power supply unit 1001 through the signal line 1042. From the output shut down circuit 1013, the signal that indicates the zero-volt state is transmitted to the feedback circuit 1011 through the signal line 1027. Further, the signal that indicates the zero-volt state is transmitted from the feedback circuit 1011 to the switching circuit 1009 through the signal line 1023.

From the switching circuit 1009 the signal that lowers the voltage output to 2.0 to 3.0 volts, which is lower than 5 volts, is transmitted to the power supply converting circuit 1005 through the signal line 1025. As a result, the voltage VD becomes 2.0 volts to 3.0 volts by way of the secondary rectification circuit 1007. This is materialized by means of the intermittent oscillation of the voltage converting circuit 1005 that contains a transformer.

Figure 9:
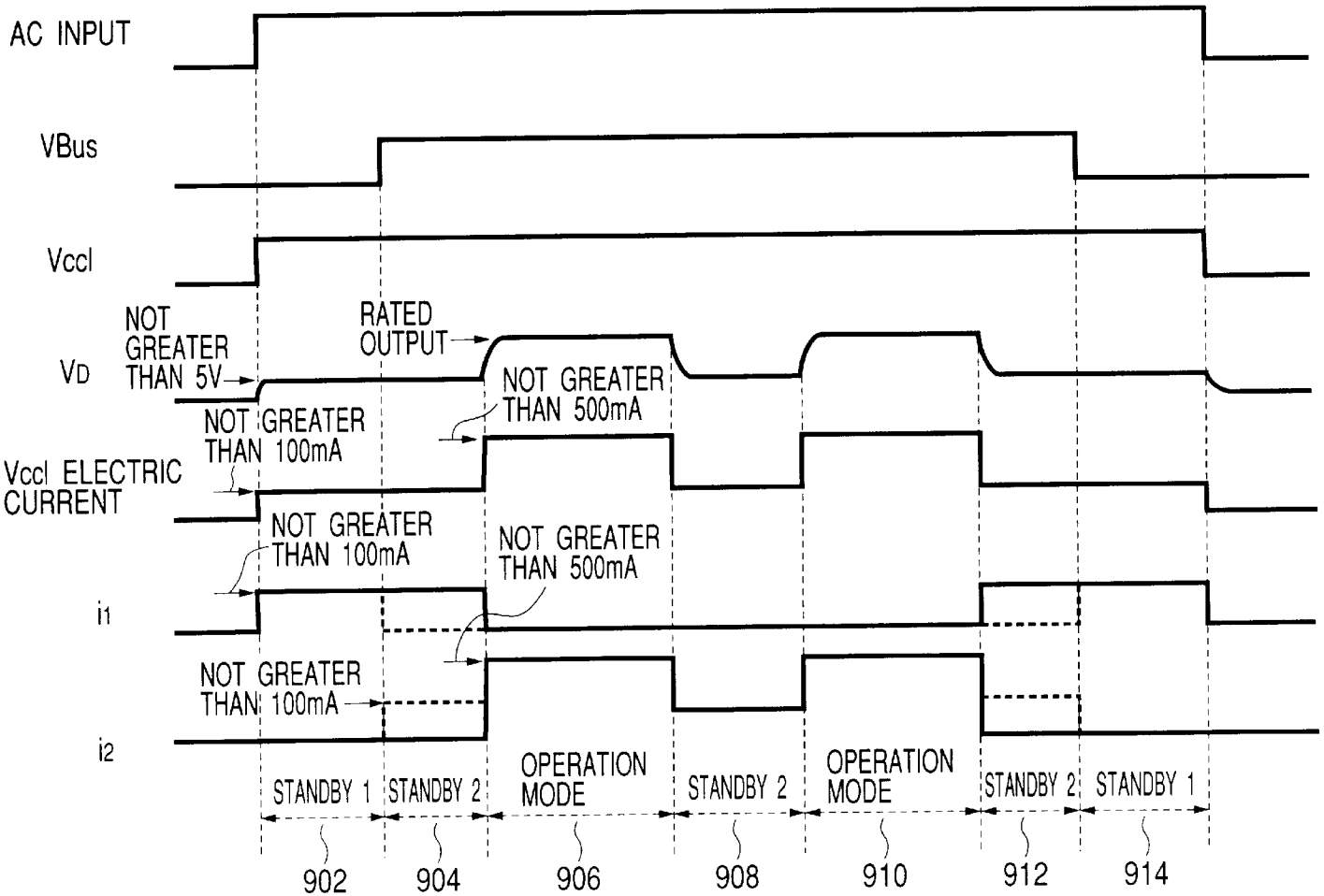
FIG. 9 is a view that shows an operational sequence in accordance with a fifth embodiment.

In this way, the dissipation power at the time of standby mode can be made lower. The operation sequence of the embodiment represented in FIG. 10 is shown in FIG. 9.

As described above, in addition to the effect described in the fourth embodiment, this embodiment demonstrates the effect that the logic circuit is protected from the high voltage to be supplied to the driving circuit.

So far, the description has been made of the first embodiment to the fifth embodiment of the present invention. The resolution of the recording head described in those embodiments is 600 dpi. However, the invention may be applicable to 1200 dpi and others without any problem. The method for discharging ink may also be the one that uses piezoelectric element.

The driving voltage of the logic circuit described above is not necessarily 5 volts. The logic circuit may be the one that can be driven at 3.3 volts or 2.5 volts.

Figure 12:
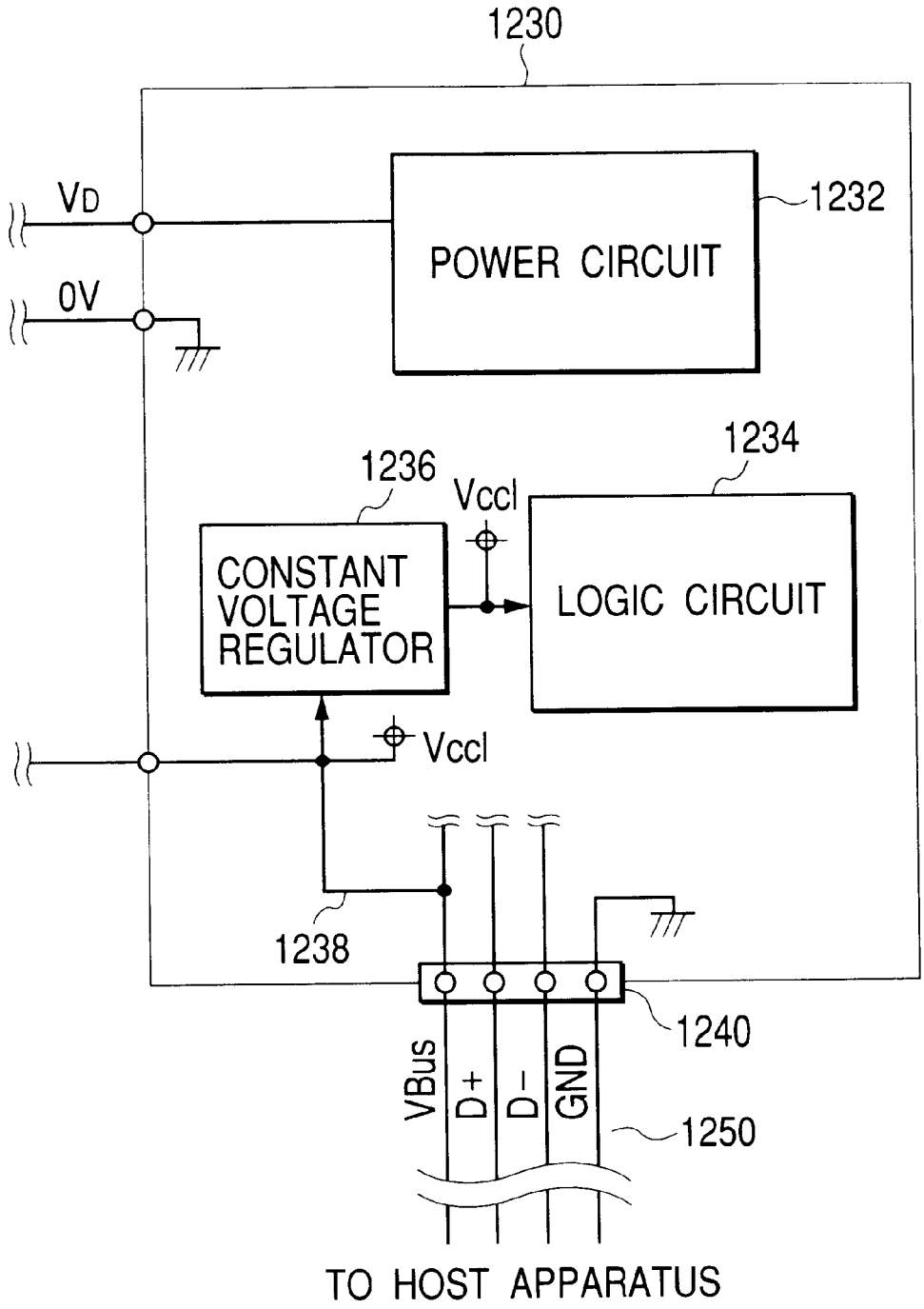
FIG. 12 is a view that shows the example of the controller unit for which a constant voltage regulator is connected between the USB interface portion and the logic circuit portion.

For example, such logic circuit can be materialized by the provision of a constant voltage regulator 1236 between the USB interface connector and the logic circuit as shown in FIG. 12. The constant voltage regulator 1236 generates the voltage of 3.3 volts with the input of 5-volt voltage from the connector 1240, thus making it possible to operate the logic circuit at 3.3 volts. With the constant voltage regulator that can generate 2.5 volts from the voltage of 5 volts, it is also possible to materialize the operation of the logic circuit at 2.5 volts.

In this manner, it becomes possible to drive a desired logic circuit with the provision of a constant voltage regulator circuit even if the voltage of the serial interface power supply line is different from the driving voltage of the logic circuit.

Figure 13:
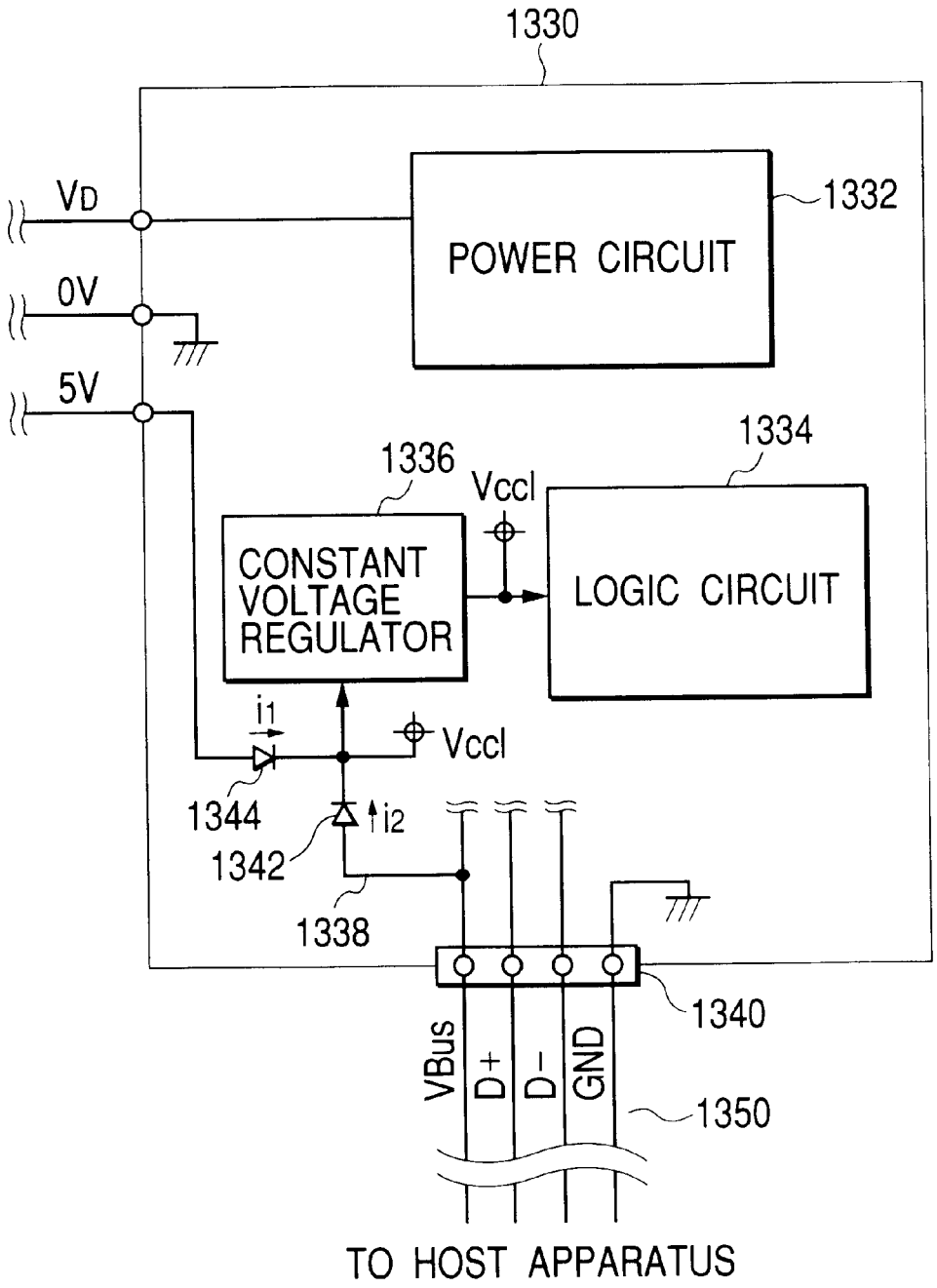
FIG. 13 is a view that shows the example of the controller unit for which a constant voltage regulator and diode are connected between the USB interface portion and the logic circuit portion.

Also, as shown in FIG. 13, a constant voltage regulator circuit 1336 may be provided between a diode and a logic circuit. The constant voltage regulator circuit 1336 generates the voltage of 3.3 volts with the input of 5-volt voltage from the connector 1340, thus making it possible to operate the logic circuit at 3.3 volts. With the constant voltage regulator that can generate 2.5 volts from the voltage of 5 volts, it is also possible to materialize the operation of the logic circuit at 2.5 volts.

In this manner, it becomes possible to drive a desired logic circuit with the provision of a constant voltage regulator circuit even if the voltage of the serial interface power supply line is different from the driving voltage of the logic circuit.

Figure 14:
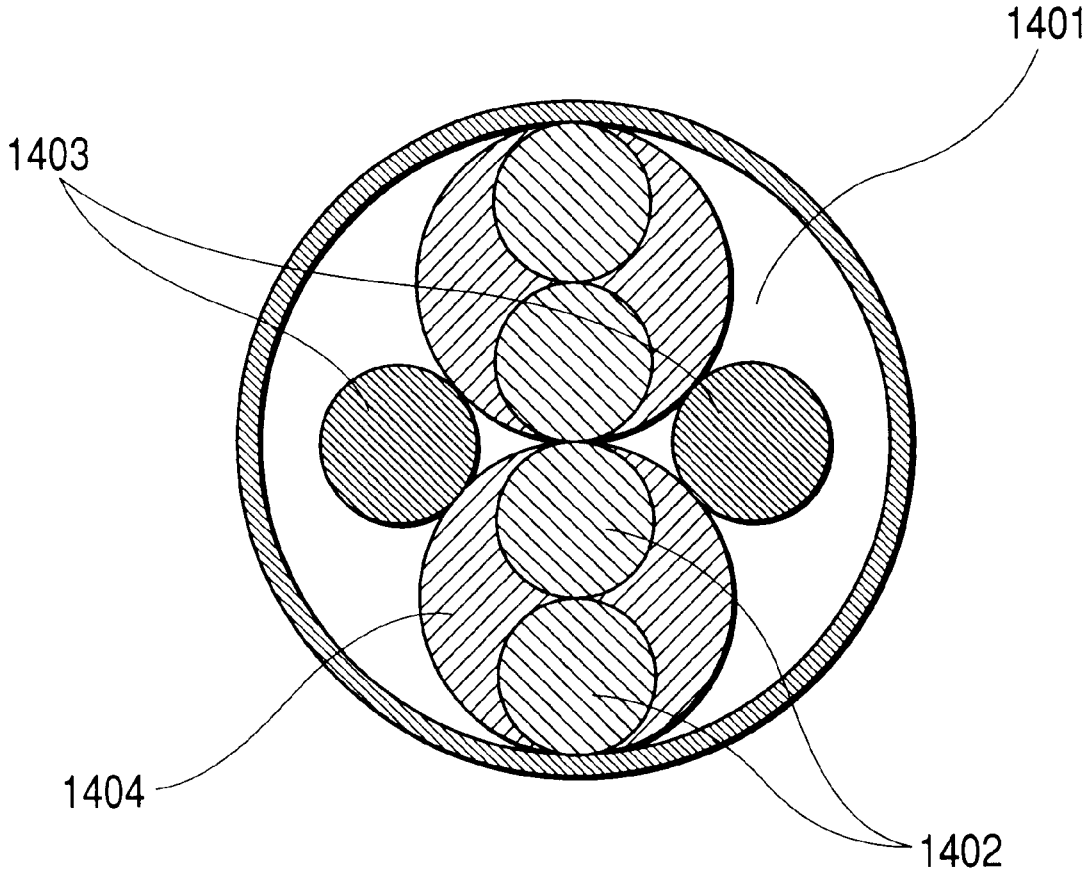
FIG. 14 is a view that shows the structure of the IEEE1394 cable.

In this respect, the present invention has been described with the above embodiments using the USB interface as the serial interface, but the invention is not necessarily limited thereto. Other serial interfaces may be usable. For example, in conjunction with FIG. 14 to FIG. 16, the description will be made of the case where the IEEE1394 interface is utilized. FIG. 14 shows the signal line of the IEEE1394 interface. A reference numeral 1401 designates the cable shield; 1402, twist pair-signal line; 1403, the power supply line; and 1404, the signal line shield. The power supply line has Vp (voltage 12 volts) and Vg (ground signal). The Vp is the voltage signal.

Figure 15:
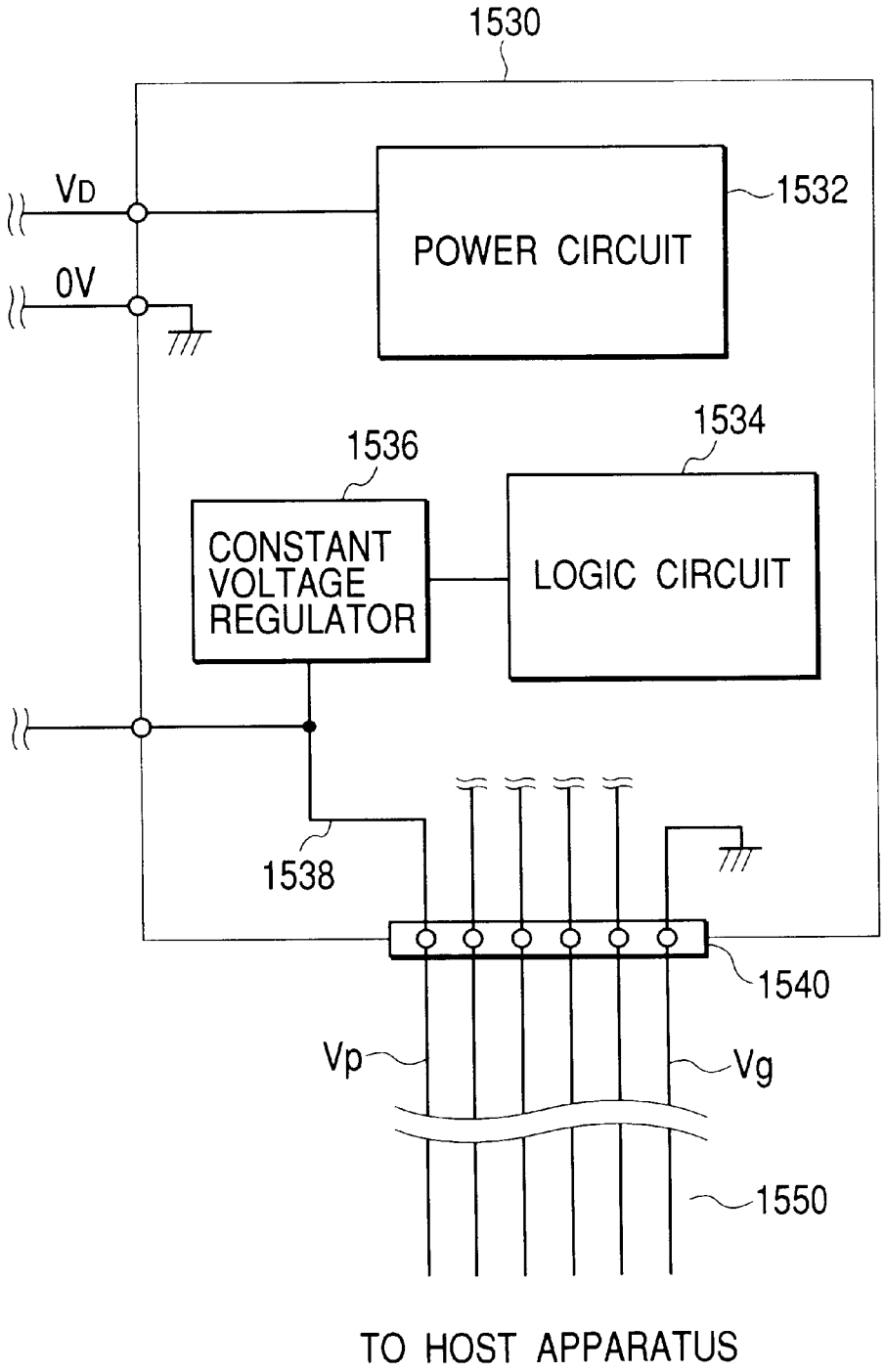
FIG. 15 is a view that shows the example of a controller unit having the IEEE1394 interface.

FIG. 15 is a view that illustrates the controller unit, which is provided with the IEEE1394 interface connector.

The constant voltage regulator circuit 1536 generates 5 volts with the input of 12 volts from the connector 1540. In this manner, a logic circuit that can be driven at 5 volts is materialized. With the constant voltage regulator circuit that can generate 3.3 volts from 12 volts, it is also possible to materialize a logic circuit operable at 3.3 volts. The number of the IEEE1394 signal lines is four, which is more than that of the USB signal lines by two. The voltage inputted from the connector 1540 can be supplied to an output shut down circuit. Then, for example, the shut down circuit can recognize by use of the signal line 1538 that the Vp becomes zero volt.

Figure 16:
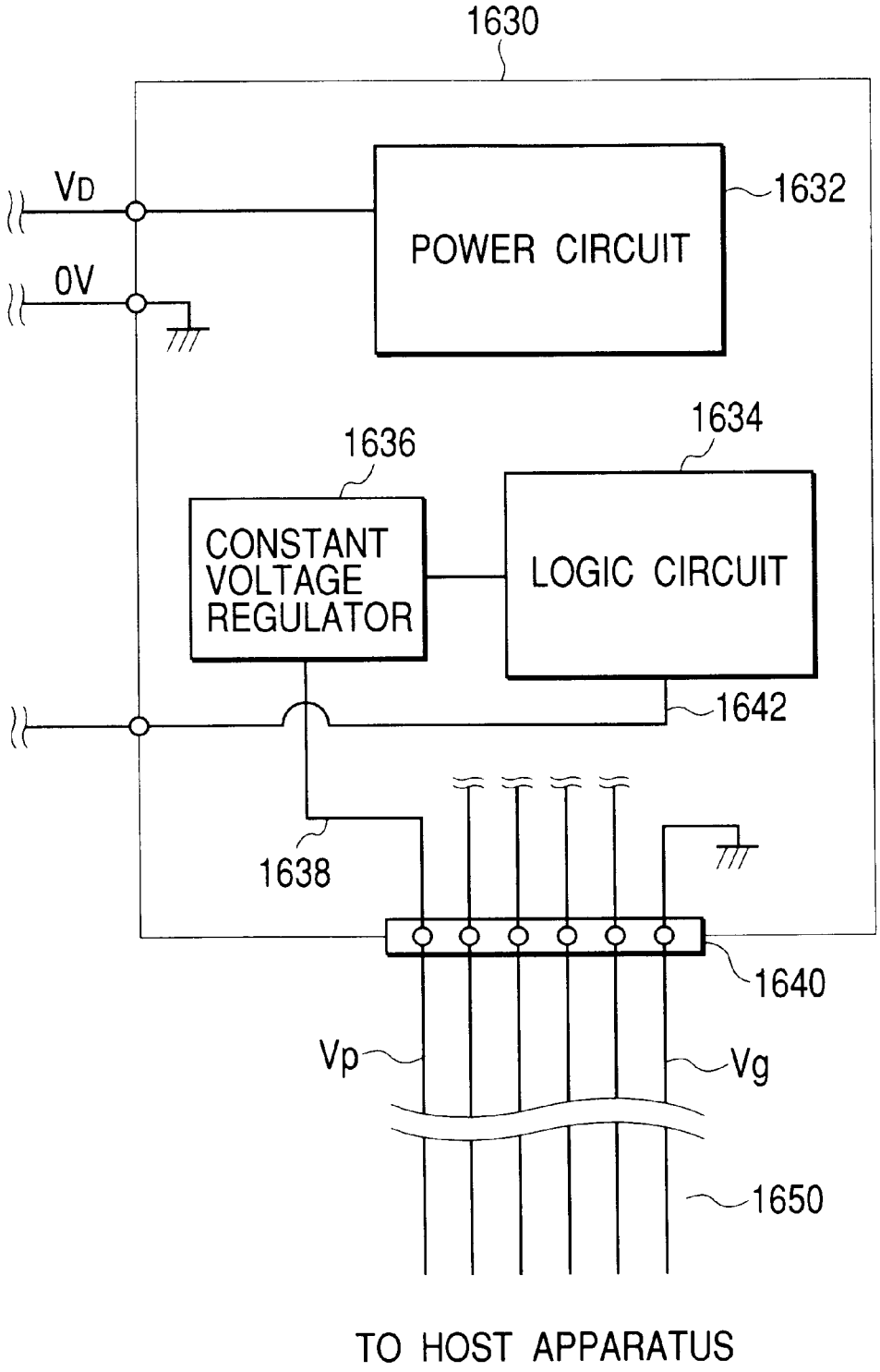
FIG. 16 is a view that shows the example of a controller unit having the IEEE1394 interface.

Also, as shown in FIG. 16, a structure can be materialized further to make supply possible from the logic circuit 1634 to the output shut down circuit by use of the signal line 1642.

In this respect, the voltage of the signal Vp of the IEEE1394 is not necessarily limited to 12 volts. There is no problem if it conforms to the IEEE1394 regulation within the voltage rage of 8 volts to 40 volts.

The current value for use of the logic circuit, which is generated by the power supply unit, as described in the fourth and fifth embodiments is not necessarily limited to 100 mA. The input voltage to the power control circuit is not necessarily limited to 24 volts, either.

For the second, third, and fifth embodiments, the circuit that transmits a signal to the feedback circuit for the suspension thereof is used as the output shut down circuit that drops off the voltage VD. However, the signal may be output to the switching circuit if only it is suitably usable for controlling the stable circuit.

As described above, with respect to a printing apparatus provided with a serial interface, the power supplied from the interface is utilized as the power source that drives the control circuit of the printing apparatus in accordance with the present invention. Then, the power supply to the printing apparatus is dedicated for driving the driving source, such as a recording head, motors, hence making it possible to materialize a smaller power supply circuit, and cost down as well.

What is claimed is:

1. An ink jet recording apparatus provided with a control circuit for controlling a recording operation using a recording head, and a driving circuit for driving a driving source to drive the recording head, comprising:

a power supply portion of a serial interface to supply power to said control circuit with a first voltage value; and a second voltage output circuit for supplying power to said driving circuit with a second voltage value.

2. An ink jet recording apparatus provided with a control circuit for controlling a recording operation using a recording head, and a driving circuit for driving a driving source to drive the recording head, comprising:

a power supply portion of a serial interface to supply power to said control circuit with a first voltage value; and a power supply unit having a first voltage output circuit for supplying power to said control circuit with the first voltage value, and a second voltage output circuit for supplying power to said driving circuit with a second voltage value, wherein the power supply to said control circuit from said first voltage output circuit and said power supply portion of said serial interface is executed in accordance with the status of said power supply portion of said serial interface.

3. An ink jet recording apparatus according to claim 2, wherein a diode for use of reverse current prevention is connected between said first voltage output circuit and said power supply portion of said serial interface.

4. An ink jet recording apparatus according to claim 3, wherein a constant voltage regulator is connected between said control circuit and said diode for use of reverse current prevention.

5. An ink jet recording apparatus according to any one of claim 2 to claim 4, wherein the maximum current value generated by said first voltage output circuit is the maximum value of current consumption of said control circuit in the standby mode of the ink jet recording apparatus.

6. An ink jet recording apparatus according to claim 1 or claim 2, wherein a constant voltage regulator is connected between said control circuit and the power supply portion of said serial interface.

7. An ink jet recording apparatus according to claim 2, wherein when said apparatus is in a designated status, said control circuit issues to said power supply unit an instruction signal for lowering the second voltage value to a designated voltage, and said power supply unit lowers said second voltage value to a designated voltage.

8. An ink jet recording apparatus according to claim 1 or claim 2, wherein said second voltage output circuit is provided with a stabilizing circuit for stabilizing the second voltage value with feedback thereto.

9. An ink jet recording apparatus according to claim 2, wherein said second voltage output circuit is provided with a stabilizing circuit for stabilizing the second voltage value with feedback thereto and said power supply unit is provided with an output shut down circuit between said stabilizing circuit and the power supply portion of said serial interface, and when the voltage of said power supply portion does not reach a designated potential, said output shut down circuit issues a signal to said stabilizing circuit, and said stabilizing circuit lowers the second voltage value to a designated voltage.

10. An ink jet recording apparatus according to claim 1 or claim 2, wherein said serial interface is an interface conforming to or being in accordance with the IEEE1394 regulation.

11. An ink jet recording apparatus according to claim 1 or claim 2, wherein said serial interface is an interface conforming to or being in accordance with the USB regulation.

12. An ink jet recording apparatus according to claim 1 or claim 2, wherein said recording head is provided with a plurality of recording elements containing electrothermal converting members to generate thermal energy as energy for discharging ink.

13. A method for controlling an ink jet recording apparatus provided with a control circuit for controlling a recording operation using a recording head, and a driving circuit to drive the recording head, comprising the steps of:

operating the control circuit in the recording operation with power supply from a power supply portion of a serial interface with a first voltage value; and operating the driving circuit by the power supply from the power supply unit with a second voltage value.

14. A method for controlling an ink jet recording apparatus according to claim 13, wherein the operation of the control circuit executes a process to lower the second voltage output to a designated voltage when the step thereof presents a designated condition.

* * * * *